US007414585B2

(12) United States Patent
Lu et al.

(10) Patent No.: US 7,414,585 B2
(45) Date of Patent: Aug. 19, 2008

(54) ANTENNA ASSEMBLY FOR USE IN A TELECOMMUNICATION DEVICE

(75) Inventors: Shih-Wen Lu, Taipei Hsien (TW); Hao-Chun Tung, Chinmen Hsien (TW)

(73) Assignee: Qisda Corporation, Taoyuan (TW)

( * ) Notice: Subject to any disclaimer, the term of this patent is extended or adjusted under 35 U.S.C. 154(b) by 316 days.

(21) Appl. No.: 11/342,047

(22) Filed: Jan. 27, 2006

(65) Prior Publication Data

US 2006/0176219 A1 Aug. 10, 2006

(30) Foreign Application Priority Data

Feb. 5, 2005 (TW) ..... 94103848 A

(51) Int. Cl.
*H01Q 1/24* (2006.01)

(52) U.S. Cl. ..... 343/702; 343/700 MS

(58) Field of Classification Search ..... 343/702, 343/700 MS, 846
See application file for complete search history.

(56) References Cited

U.S. PATENT DOCUMENTS

| | | | | |
|---|---|---|---|---|
| 6,366,243 | B1 * | 4/2002 | Isohatala et al. | 343/700 MS |
| 6,970,140 | B2 * | 11/2005 | Hibino et al. | 343/860 |
| 7,098,856 | B2 * | 8/2006 | Okado | 343/702 |
| 2007/0139281 | A1 * | 6/2007 | Park et al. | 343/702 |

* cited by examiner

*Primary Examiner*—HoangAnh T Le
(74) *Attorney, Agent, or Firm*—Ladas and Parry LLP

(57) ABSTRACT

An antenna assembly is use in a telecommunication device having a first printed circuit board and a second printed circuit board disposed right below and facing the first printed circuit board. The antenna assembly includes: radiating metal strip having a main strip section for disposing on an upper surface of the first printed circuit board, a feeding strip section extending from the main strip section through a first through hole in the first printed circuit board toward the second printed circuit board, and a grounding strip section extending from the main strip section through a second through hole in the first printed circuit board toward the second printed circuit board. After assembly, the feeding and grounding strip sections tend toward an upper surface of the second printed circuit board.

17 Claims, 4 Drawing Sheets

ANTENNA ASSEMBLY FOR USE IN A TELECOMMUNICATION DEVICE

FIELD OF THE INVENTION

The present invention relates to an antenna assembly, more particularly to an antenna assembly for use in a local wireless system and a telecommunication device, such as a mobile phone.

BACKGROUND OF THE INVENTION

Due to advance of the telecommunication technology, the local wireless system and the mobile phone are provided with in-built antenna assemblies respectively for transmitting and receiving signals from far and nearby.

FIG. 1 shows a conventional mobile phone 2 is shown to include an upper casing 6, a lower casing 8, an input keypad 12, and a printed circuit board 14. The upper casing 6 has an LCD panel 10, and is formed with a plurality of input keys 602.

The printed circuit board 14 generally includes several complicated circuits, chipsets, and other electronic components for different functions. The printed circuit board 14 is disposed below the keypad 12. The keypad 12 is formed with a plurality of conductive pads 1202 respectively aligned with the input keys 602 of the upper casing 6. Depression of an input key 602 via an actuator (not shown) results in a contact between the respective conductive pad 1202 and the respective circuit, thereby sending a signal to the signal-processing module (not shown).

As a rule, the mobile phone 2 is provided with an antenna assembly according to the requirement for transmitting and receiving signals. For communication with a base station, an antenna assembly 3 is fabricated on the top portion of the printed circuit board 14. For communication with the local wireless system, for example WLAN, another antenna assembly 4 (hence WLAN antenna assembly) is fabricated on the lower portion of the printed circuit board 14. As shown in FIG. 1, the antenna assembly 4 has a F-shaped configuration and includes a radiating metal strip having a main strip section 402 mounted on the printed circuit board 14 adjacent to the periphery thereof, a feeding strip section 404 for coupling to the signal-processing module (not shown) and a grounding strip section 406 for grounding purposes.

Moreover, the upper and lower surface of the printed circuit board 14 defines a naked space 16 for receiving the main strip section 402, the feeding strip section 404 and the grounding strip section 406. Since the naked space is free from circuits and is defined by a portion of the FR 4 standard laminates, which as a whole serves as the major medium for forming the printed circuit board 14 once the circuits are fabricated thereon. Enlargement of the distance between the main strip section 402 and the conductive layer at a lower elevation in the printed circuit board 14 can result in decrease of the Q value, thereby enhancing the storage capacity of the antenna assembly and consequently permitting the latter to possess a wider band of operating frequency.

As a matter of fact, due to the presence of the naked space 16 in the printed circuit board, it makes the manufactures of the electronic device more difficult to design the complicated circuit paths on the remaining space of the printed circuit board. Since the mobile phone (each electronic device) is under the trend toward the compact size, formation of the aforesaid naked space 16 results in waste of precious space in the printed circuit board. In addition, the manufacturers of the antenna assembly aggressively want to widen the distance between the main strip section and the conductive layer disposed at a lower elevation.

Therefore, the main object of the present invention is to provide an antenna assembly for solving the aforesaid problems.

SUMMARY OF THE INVENTION

The object of the present invention is to provide two built-in antenna assemblies within a mobile phone such that the latter can use the first antenna assembly for communicating with the WLAN system and the second one of communicating with the base station.

In one aspect of the present invention, an antenna assembly is provided for use in a telecommunication device, the telecommunication device including a first printed circuit board and a second printed circuit board disposed right below and facing the first printed circuit board. The antenna assembly includes: a radiating metal strip having a main strip section for disposing on an upper surface of the first printed circuit board, a feeding strip section extending from the main strip section through a first through hole in the first printed circuit board toward the second printed circuit board, and a grounding strip section extending from the main strip section through a second through hole in the first printed circuit board toward the second printed circuit board. After assembly, the feeding and grounding strip sections tend toward an upper surface of the second printed circuit board.

In another aspect of the present invention, a telecommunication device is provided to include a first printed circuit board and a second printed circuit board disposed right below and facing the first printed circuit board. The telecommunication device includes: a wireless antenna assembly including a radiating metal strip having a main strip section for disposing on an upper surface of the first printed circuit board, a feeding strip section extending from the main strip section through a first through hole in the first printed circuit board toward the second printed circuit board, and a grounding strip section extending from the main strip section through a second through hole in the first printed circuit board toward the second printed circuit board. After assembly, the feeding and grounding strip sections tend toward an upper surface of the second printed circuit board.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTIONS OF THE PREFERRED EMBODIMENT

Figure 1:
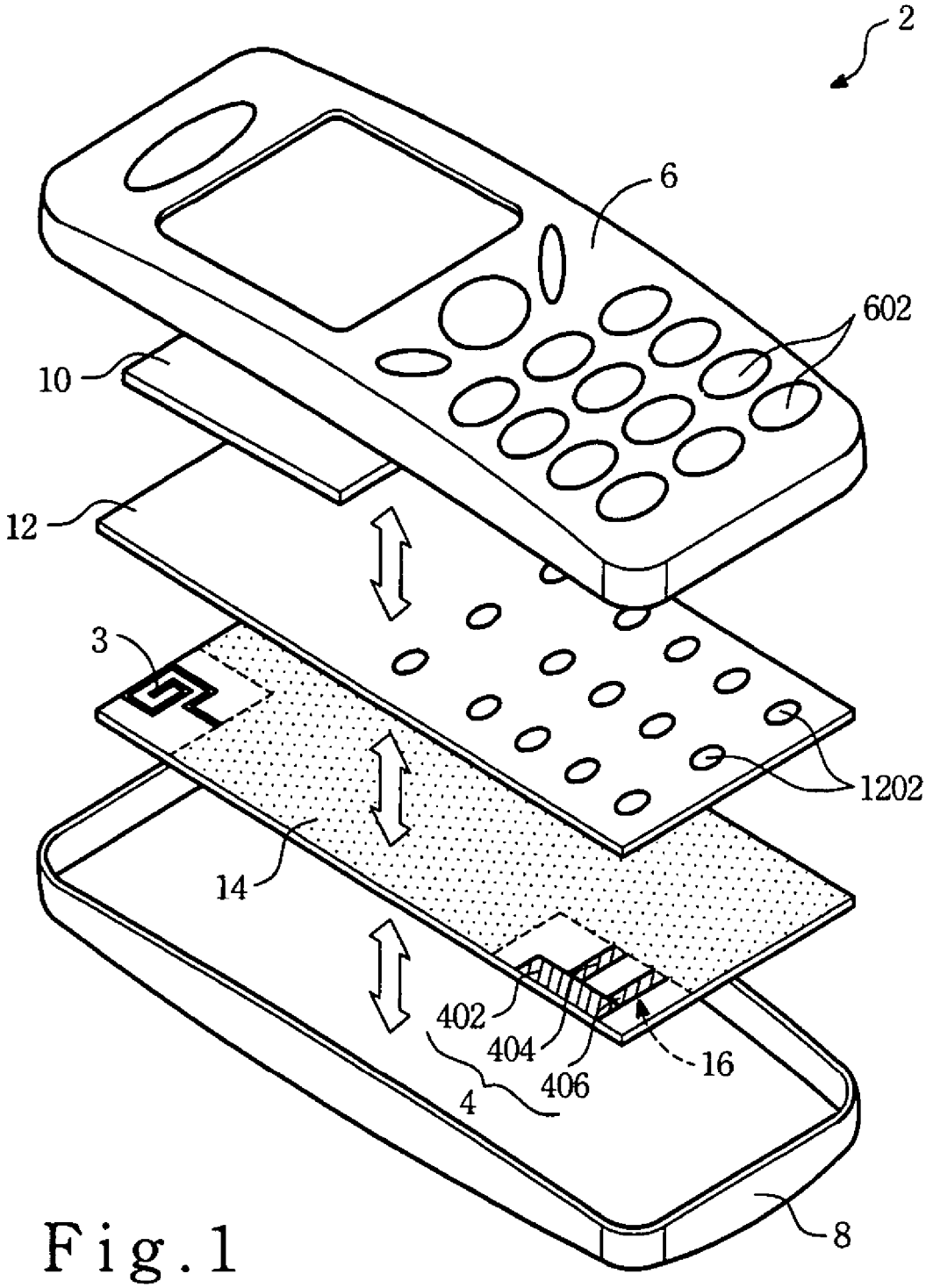
Fig. 1 (Prior Art)
FIG. 1 is an exploded, perspective view of a conventional telecommunication device provided with a F-shaped antenna assembly.
Figure 2A:
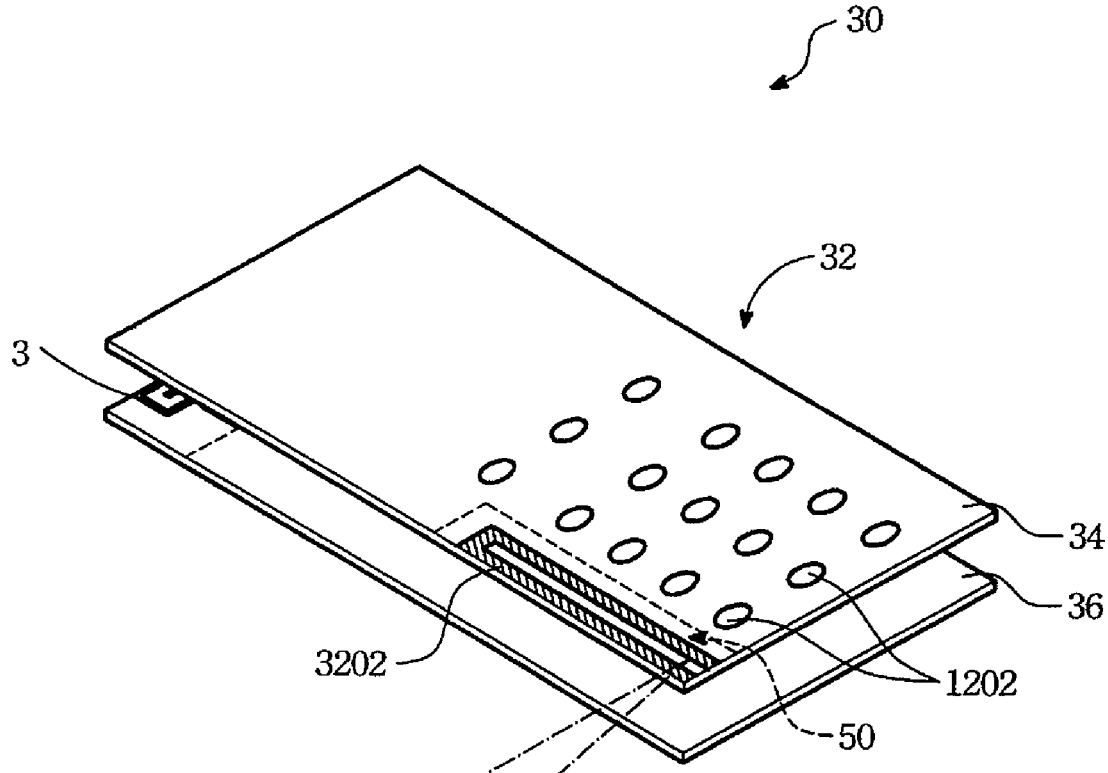
FIG. 2A is a perspective view, illustrating how an antenna assembly is mounted in a telecommunication device of the present invention.
Figure 2B:
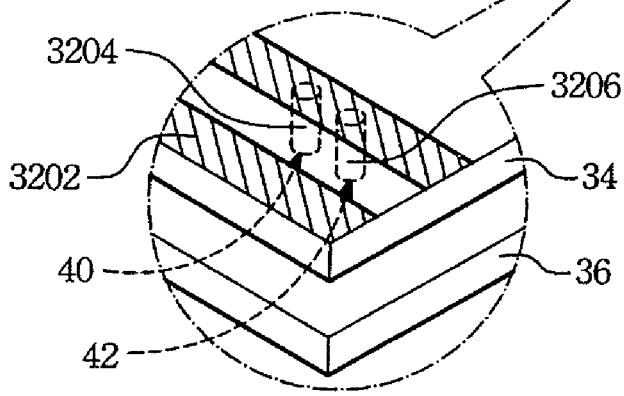
FIG. 2B is an enlarged view of an encircled portion the telecommunication device of the present invention.

Referring to FIG. 2, a perspective view of the preferred embodiment of a telecommunication device 30 according to the present invention is shown to include an outer casing (not visible since removed), a first printed circuit board 34, a second printed circuit board 36, and an antenna unit consisting of a distal antenna assembly 3 (see FIG. 1) and a antenna assembly 32, for example LAN antenna assembly.

The telecommunication device 30 can be a mobile phone. In other words, the LAN antenna assembly 32 can be used in a WLAN system. The first and second printed circuit board 34, 36 are made from FR 4 standard laminates. The first printed circuit board 34 is formed with first and second through holes 40, 42. The second printed circuit board 36 is disposed right below the first printed circuit board 34 so as to face the former.

The distal antenna assembly 3 is generally mounted on the second printed circuit board 36, since the latter being the main circuit board of the mobile phone 30. The LAN antenna assembly 32 is mounted on an upper surface of the first printed circuit board 34, and includes a radiating metal strip having a main strip section 3202, a feeding strip section 3204, and a grounding strip section 3206. The main strip section 3202 is fabricated on the upper surface of the first printed circuit board 34. In this embodiment, the keypad of the mobile phone serves as the first printed circuit board 34 such that the main strip section 3202 is mounted on the keypad while the feeding and grounding strip sections 3204, 3206 extend respectively from a lower surface of the main strip section through the first and second through holes 40, 42 in the keypad toward the second printed circuit board 36.

The first printed circuit board 34 has a naked space 50 (i.e. no circuits exist therein) at a lower surface thereof in alignment with the main strip section 3202 of the radiating metal strip. In this embodiment, the first and second through holes 40, 42 are formed through the naked space 50 of the first printed circuit board 34 to permit extension of the feeding strip section 3204 and the grounding strip section 3206. The feeding strip section 3204 is used for coupling to a signal-processing module (not shown). The grounding strip section 3204 serves as the ground. The second printed circuit board 36 is vertically spaced apart from the first printed circuit board 34 at a predetermined distance. In this embodiment, one copper foil strip of the first printed circuit board 34 serves as the radiating metal strip.

Figure 3:
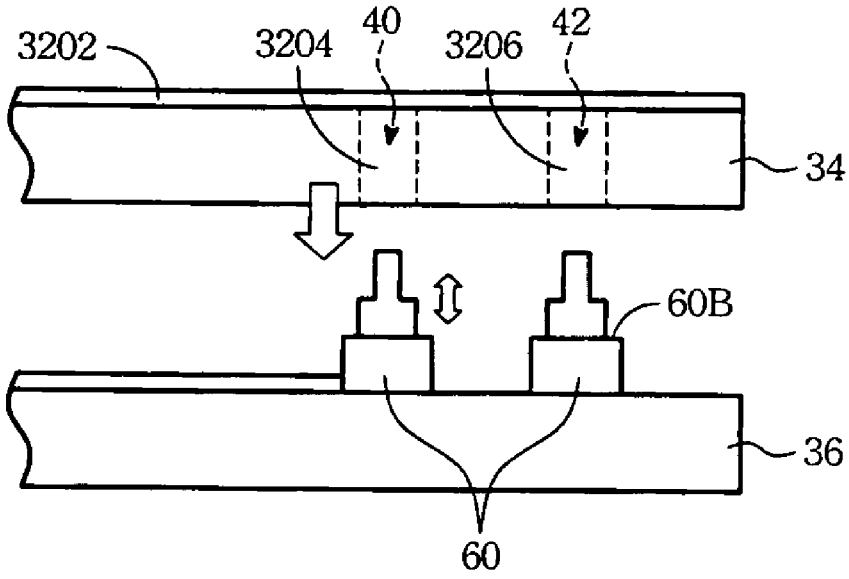
FIG. 3 shows a fragmentary view of the telecommunication device of the present invention.

Referring to FIG. 3, since the first and second printed circuit boards 34, 36 are spaced apart from each other at the predetermined distance and for establishing electrical communication therebetween, the second printed circuit board 36 is formed with two conductive posts 60 respectively projecting upwardly from the upper surface and extending into the first and second through holes 40, 42 respectively such that after assembly the feeding and grounding strip sections 3204, 3206 are respectively in contact with the conductive posts 60, thereby establishing electrical communication between the first and second circuit boards 34, 36. Since each conductive post 60 has an abutment shoulder 60B, the peripheries confining the first and second holes 40, 42 can be seated respectively on the shoulders 60B of the conductive posts 60. Since the distance between the first and second printed circuit boards 34, 36 is enlarged so as to decrease the Q value of the antenna assembly 32, thereby enhancing the storage capacity of the antenna assembly 32 and consequently permitting the latter to possess a wider band of operating frequency.

Figure 4:
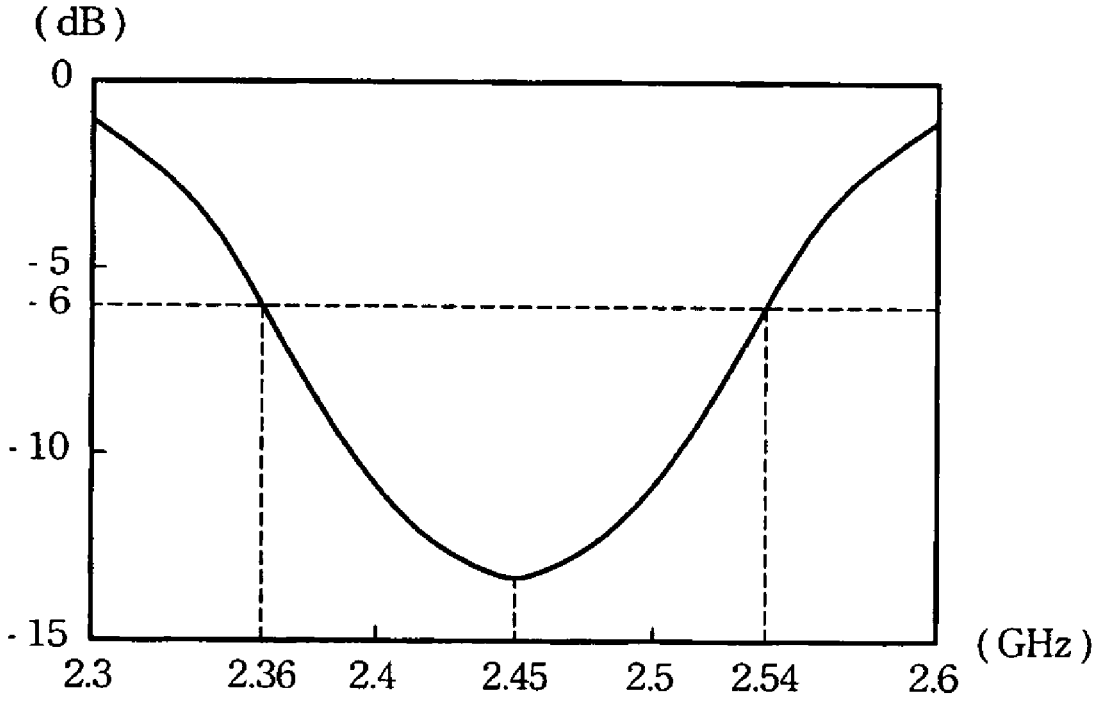
FIG. 4 is a diagram of computer stimulation result for the antenna assembly employed in the telecommunication device of the present invention.

FIG. 4 is a diagram of the computer stimulation results, illustrating the input return loss (dB) verses frequency (GHz) for the antenna assembly 32. In practice, the first printed circuit board 34 is constructed to have a dimension of 37.2×64.5 $mm^2$, which is suitable to be placed within a mobile phone of foldable type (generally known as flip phone). Under the condition that the main strip section 3202 is spaced vertically apart from the upper surface of the second printed circuit board 36 by a distance of 3 mm, the antenna assembly 32 accordingly occupies a space of 6×20 $mm^2$ in the first printed circuit board 34. Arrangement of the antenna assembly 32 permits the mobile phone to operate under the frequency centering around 2.45 GHz. In case the main strip section 3202 has a loss return at −6 dB, the operating bandwidth can be 90 MHz. Therefore, the antenna assembly 32 is compatible with the Bluetooth, IEEE 802.11b, IEEE 802.11g protocols of short distance wireless communication.

Figure 5A:
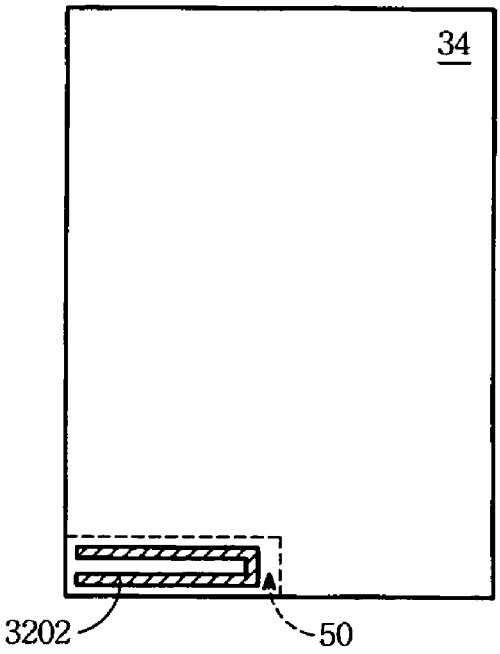
FIG. 5A to FIG. 5D show four different designs of the antenna assembly produced according to the present invention.
Figure 5B:
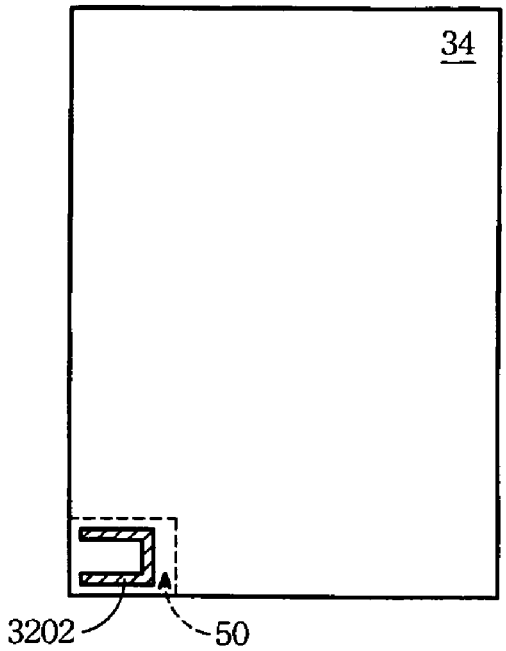
Figure 5C:
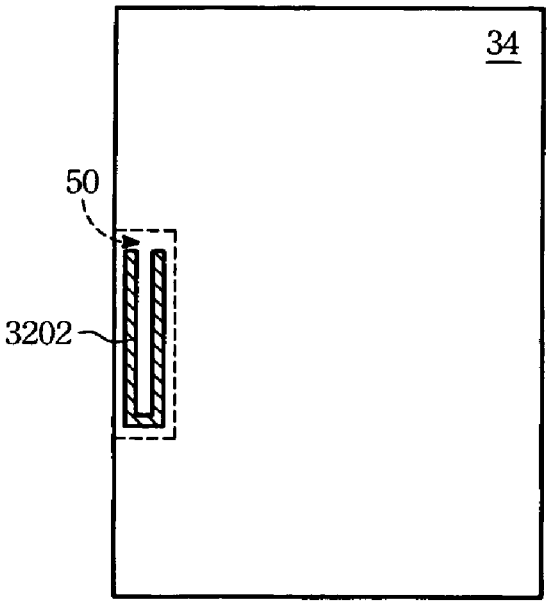
Figure 5D:
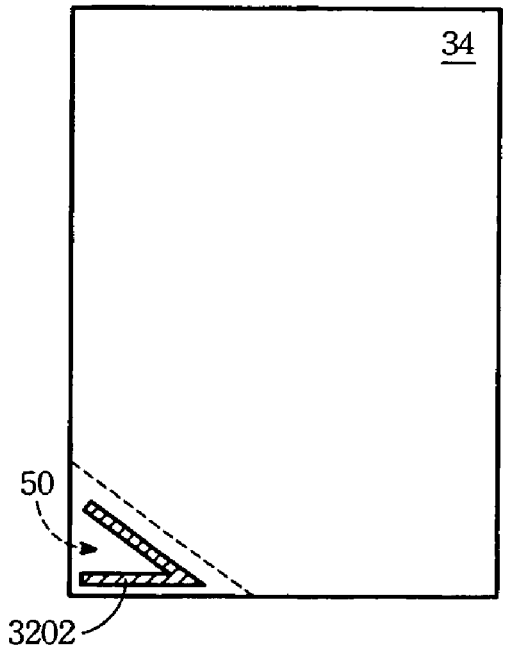

In the above mentioned mobile phone, the antenna assembly 32 is mounted on the upper surface of the first printed circuit board 34 at one corner thereof adjacent to the periphery confining the upper surface thereof. FIGS. 5A to 5D show four different designs of the antenna assembly 32, wherein in FIGS. 5A, 5B and 5C, the main strip portion 3202 of the antenna assembly 32 has a generally U-shaped configuration while another one has a generally V-shaped configuration, as best shown in FIG. 5D.

In summary, since the LAN antenna assembly 32 is mounted on the upper surface of the first printed circuit board 34, the mobile phone 30 possesses two antenna assemblies 3, 32 for transmitting and receiving signals from far and near via the local base station. The mobile phone 30 accordingly produced is compact in size by virtue of designing the main strip section 3202 of the radiating metal strip in the naked space of the first printed circuit board 34. In addition, presence of the conductive posts 60 on the second printed circuit board 36 consequently widens the distance between the first and second printed circuit boards 34, 36, which, in turn, results in decrease of the Q value, thereby enhancing the storage capacity of the antenna assembly and consequently permitting the latter to possess a wider band of operating frequency.

While the invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An antenna assembly for use in a telecommunication device, the telecommunication device including a first printed circuit board and a second printed circuit board disposed right below and facing the first printed circuit board, the antenna assembly comprising:

a radiating metal strip including a main strip section disposing on an upper surface of the first printed circuit board, a feeding strip section extending from said main strip section through a first through hole in the first printed circuit board toward the second printed circuit board, and a grounding strip section extending from said main strip section through a second through hole in the first printed circuit board toward the second printed circuit board;

whereby, said feeding and grounding strip sections extending from said main strip section tend toward an upper surface of the second printed circuit board;

wherein the telecommunication device is a mobile phone, the first printed board circuit board is an input keypad of the mobile phone, and the second printed circuit board is a main circuit board of the mobile phone.

2. The antenna assembly according to claim 1, wherein the first printed circuit board has a naked space at a lower surface thereof in alignment with said main strip section, said first and second through holes being formed through said naked space to permit extension of said feeding and grounding strip sections therethrough.

3. The antenna assembly according to claim 1, wherein said main strip section is mounted on the upper surface of the first printed circuit board adjacent to a periphery confining the upper surface of the first printed circuit board.

4. The antenna assembly according to claim 1, wherein said main strip section has an inverted U-shaped configuration.

5. The antenna assembly according to claim 1, wherein said main strip section has a generally V-shaped configuration.

6. The antenna assembly according to claim 1, wherein the first printed circuit board is spaced apart from the second printed circuit board at a predetermined distance.

7. The antenna assembly according to claim 6, wherein the upper surface of the second printed circuit board is formed two conductive posts respectively extending into the first and second through holes in the first printed circuit board such that after assembly the first and second printed circuit boards are in electrical communication therebetween by virtue of engagement between said feeding and grounding strip sections and said conductive posts.

8. A telecommunication device including a first printed circuit board and a second printed circuit board disposed right below and facing the first printed circuit board, the telecommunication device comprising:

an antenna assembly including a radiating metal strip having a main strip section for disposing on an upper surface of the first printed circuit board, a feeding strip section extending from said main strip section through a first through hole in the first printed circuit board toward the second printed circuit board, and a grounding strip section extending from said main strip section through a second through hole in the first printed circuit board toward the second printed circuit board;

whereby, said feeding and grounding strip sections extending from said main strip section tend toward an upper surface of the second printed circuit board;

wherein the telecommunication device is a mobile phone, the first printed circuit board is an input keypad of the mobile phone, and the second printed circuit board is a main circuit board of the mobile phone.

9. The telecommunication device according to claim 8, wherein the first printed circuit board has a naked space at a lower surface thereof in alignment with said main strip section, said first and second through holes being formed through said naked space to permit extension of said feeding and grounding strip sections therethrough.

10. The telecommunication device according to claim 8, wherein said antenna assembly is mounted on the upper surface of the first printed circuit board adjacent to one corner thereof.

11. The telecommunication device according to claim 8, wherein said antenna assembly is mounted on the upper surface of the first printed circuit board adjacent to a periphery confining the upper surface of the first printed circuit board.

12. The telecommunication device according to claim 8, wherein the first printed circuit board has a copper foil strip on the upper surface serving as said radiating metal strip.

13. The telecommunication device according to claim 8, wherein said main strip section has an inverted U-shaped configuration.

14. The telecommunication device according to claim 8, wherein said main strip section has a generally V-shaped configuration.

15. The telecommunication device according to claim 8, wherein the first printed circuit board is spaced apart from the second printed circuit board at a predetermined distance.

16. The telecommunication device according to claim 8, wherein the upper surface of the second printed circuit board is formed two conductive posts respectively extending into the first and second through holes in the first printed circuit board such that after assembly the first and second printed circuit boards are in electrical communication therebetween by virtue of engagement between said feeding and grounding strip sections and said conductive posts.

17. The telecommunication device according to claim 8, further comprising a distal antenna assembly mounted on the second printed circuit board.

* * * * *